US005118238A

United States Patent [19]

Crudo

[11] Patent Number: 5,118,238

[45] Date of Patent: Jun. 2, 1992

[54] DEBINDER FOR STRIP-BOUND BOOKS AND DOCUMENTS

[75] Inventor: Phillip M. Crudo, Sparks, Nev.

[73] Assignee: Velobind, Inc., Fremont, Calif.

[21] Appl. No.: 539,067

[22] Filed: Jun. 15, 1990

[51] Int. Cl.[5] ..... B42C 17/00

[52] U.S. Cl. ..... 412/15; 83/467.1

[58] Field of Search ..... 83/467.1, 633, 933; 412/15

[56] References Cited

U.S. PATENT DOCUMENTS 4,964,323 10/1990 Fortney ..... 83/467.1 X 4,986,156 1/1991 McGinnis ..... 83/467.1

*Primary Examiner*—Paul A. Bell

*Attorney, Agent, or Firm*—Julian Caplan

[57] ABSTRACT

To remove binding strips of the type shown in U.S. Pat. No. 4,369,013 from the book or document bound thereby, a debinding machine is used. The machine has a platen on which the spine of the book is supported and a perpendicular back plate against which one face of the book is forced, one binding strip fitting into a gap between the lower edge of the back plate and the platen. Pulling a handle causes a knife blade to enter behind the aforesaid book face and the strip, cutting the studs so that the strip is severed from the book. The other studs may then be pulled out of the holes in the sheets of the book by pulling away the remaining strip.

15 Claims, 3 Drawing Sheets

DEBINDER FOR STRIP-BOUND BOOKS AND DOCUMENTS

BACKGROUND OF THE INVENTION

1. Field of the Invention

This invention relates to a new and improved apparatus for debinding strip bound books and documents. More particularly, the device cuts through the studs which pass through holes in the sheets of the book and extend from a first strip to a second strip. This permits the book to be disassembled.

2. Description of Related Art

Plastic binding strips are shown in U.S. Pat. No. 4,369,013. The studs of a first strip pass through holes in the sheets to be bound and also through holes in a second strip, heads being formed on the ends of the studs on the outer side of the second strip. In order to debind the book, two means have heretofore been employed. A hand tool, such as shown in U.S. Pat. No. 3,851,391, and in Design Patent 236,794, has been used by pulling it from one end of the strip to the other, a blade on the tool cutting the studs one at a time.

Another means for debinding such strips is shown in U.S. Pat. No. 3,756,625, column 9, line 64 et seq., wherein the heads of the rivets on the outer ends of the studs are heated so that they can easily be pulled off.

The present invention uses a materially different apparatus than that heretofore employed.

SUMMARY OF THE INVENTION

A small manual machine is used. The book to be debound is positioned substantially vertically on a platen and is pushed against a front plate in such manner that one binding strip is behind the plane of the back of the book as it is held against the front plate. A vertically reciprocating knife in alignment with the plane of the front plate is brought down into a position between the back of the book and the adjacent edge of the strip. The knife cuts the studs which fit into the aforesaid strip as the knife is brought down. After the strip has been cut off from the remainder of the book, the studs may be removed from the apertures in the sheets by pulling the remaining strip away.

Other objects of the present invention will become apparent upon reading the following specification and referring to the accompanying drawings in which similar characters of reference represent corresponding parts in each of the several views.

IN THE DRAWINGS

The accompanying drawings, which are incorporated in and form a part of this specification, illustrate embodiments of the invention and, together with the description, serve to explain the principles of the invention:

DESCRIPTION OF PREFERRED EMBODIMENTS

Figure 1:
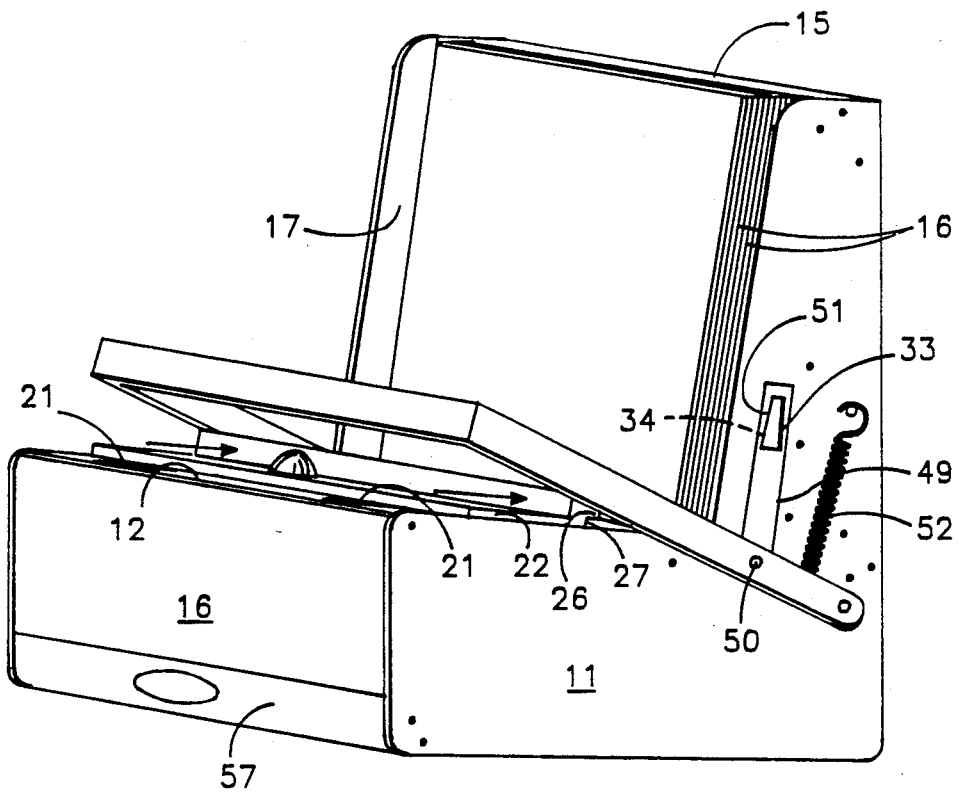
FIG. 1 is a perspective view of the machine in a position at the commencement of operation thereof.
Figure 2:
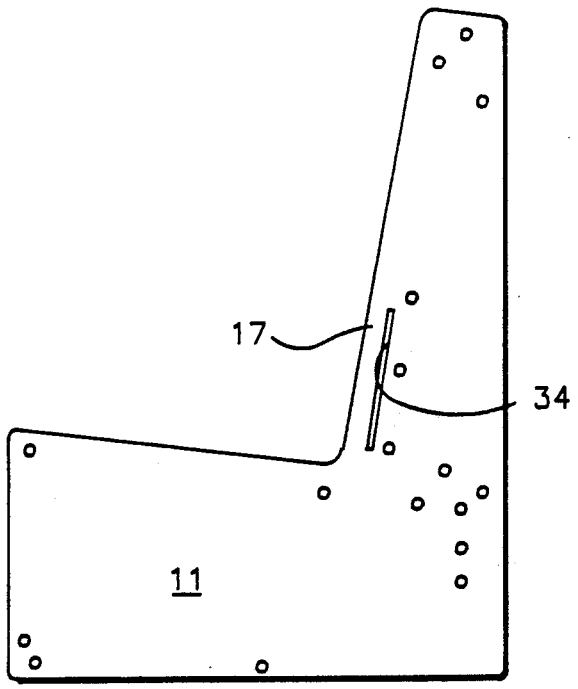
FIG. 2 is a side elevational view of a side plate of the machine.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Books of the type to be debound by the present invention have a plurality of sheets 6 formed with apertures spaced inward from their spine edges. A first strip extends along one face of the book and has a plurality of studs 8 which extend through the holes in sheets 6 and also extend through holes in second strip 9 on the opposite side of the book. Heads are formed on the studs 8 on the outside of strip 9, binding the book together. At times it is necessary for the user to debind the book in order to remove or add pages or reuse the sheets 6 for other purposes. The present invention is used to accomplish this purpose.

Sides 11 extend vertically on either side of the machine. Slanting downward rearward from the front of the machine is a platen 12, the outer end of the platen 12 being located only part-way up from the bottom edge of sides 11. Front plate 13 extends down from the top edges of the sides of 11 in the direction of the platen 12 and perpendicular thereto, but the lower end 18 of front plate 13 is spaced upward from the plane of platen 12. The apparatus is closed off by a vertical back 14 at the back edge of sides 11, a top 15 joining the upper ends of front plate 13 and back 14, a horizontal bottom 20 extending forwardly from the bottom of back 14 and a front 16 joining the front edge of the platen 12 and the front edge of the bottom 20. It will be noted, particularly with reference to FIG. 3, that there are forward projections 17 of the sides 11 which extend somewhat forwardly of front 13.

Figure 4:
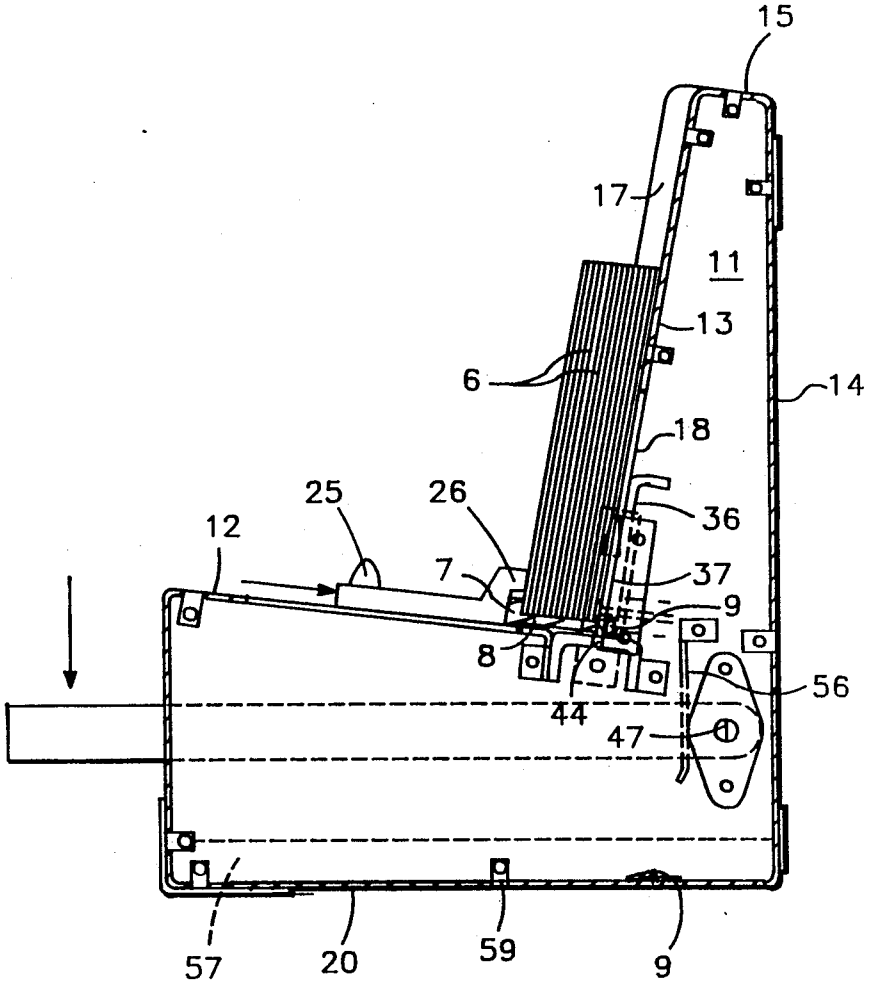
FIG. 4 is a view similar to FIG. 3 with the handle in down position and showing a book in place.

A pair of longitudinal slots 21 is formed in platen 12. Slidable from front to rear over the face of platen 12 is a pressure bar 22. A screw 14 on the underside of platen 12 passes through a washer 23 and then through slot 21, and is screwed into pressure bar 22. Thus the pressure bar 22 may slide over the surface of the platen 12. The rearward, or working, face of pressure bar 22 is formed with a transverse face 26, the lower edge of which is formed with a notch 27 complementary to one of the strips 7 or 9. Thus, as shown in FIG. 4, when a book is placed so that its spine edge rests on the platen 12 and its rearward face rests on the front 13, the pressure bar may be moved rearward by means of knob 29 or other means attached thereto so that the face 26 pushes the book against the front plate 13, the outer strip 7 being received in the notch 27 and held down relative to the platen 12.

Figure 5:
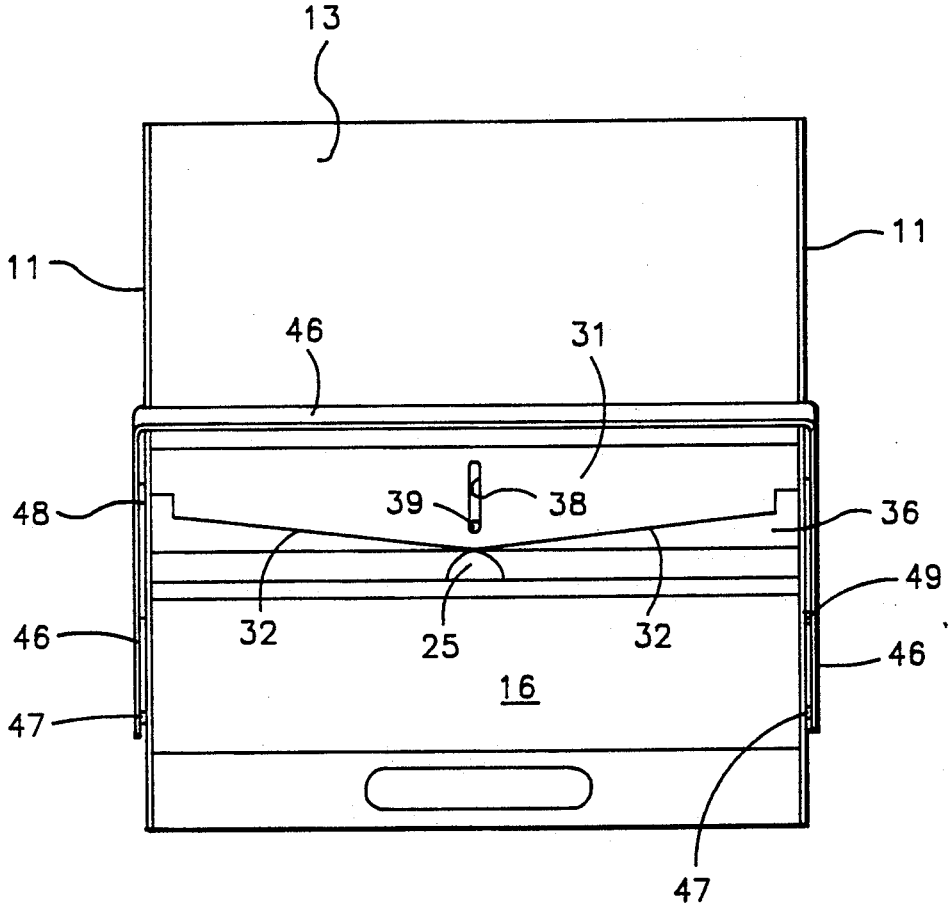
FIG. 5 is a front elevational view showing the shape of the knife.

Reciprocating in the plane of front plate 13 is a blade 31 which has inwardly slanted bottom edges 32. The use of a double slanted bottom edge 32, best shown in FIG. 5, is that the studs 8 are cut a few at a time, rather than all simultaneously, thereby reducing the amount of force required to operate the blade 31. Blade 31 is disposed within the projections 17, which form end guides thereof, and the blade 31 is further formed with ears 33 which extend out through longitudinal slots 34 in the sides 11 parallel to front plate 13.

As has been stated, front plate 13 terminates at its bottom edge 18. Behind the plane of front plate 13 (and of blade 31) is a blade backing plate 36 which extends transversely between the sides 11. There is a gap 37 at the bottom of plate 36 which is of a dimension such that the strip 9 may extend into the gap and be positioned immediately rearward of the path of reciprocation of blade 31. A slot 38 is formed in knife 31 and fitting within the slot 38 is a rivet 39. The rear end of the rivet 39 is captured in a rivet lock 41 behind blade backing plate 36. Thus, backing plate 36 guides the reciprocation of the blade 31 as hereinafter appears.

Below the plane of platen 12 is a blade guide 43 which, in effect, constitutes an extension of the platen 12. Guide 43 extends between the sides 11 and is formed with a slot extending transversely. When the blade 31 is in downward position, its lower edge fits through the slot 44, which assists in holding the blade in alignment.

Figure 3:
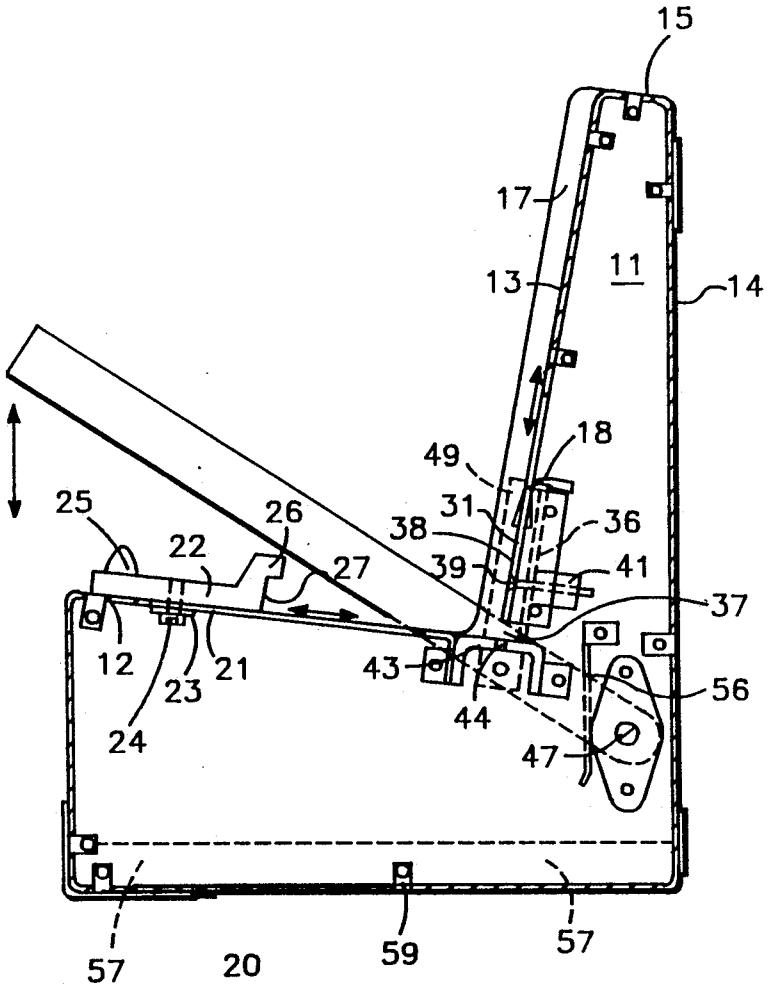
FIG. 3 is a vertical sectional view taken longitudinally through the machine with the handle in up position and no book in place.

A U-shaped handle 46 extends forwardly from shoulder screws 47 which attach the ends of handle 4-6 to sides 11. In its up position the handle 46 slants upwardly forwardly, as shown in FIG. 3, and in its downward position it is substantially horizontal, as shown in FIG. 4.

Links 49 on either side of the machine are pivotted to handle 46 by pins 50. The upper ends of links 49 are formed with slots to receive the ears 33 at the outer ends of blade 31 which extend through slots 34 in sides. To prevent binding, slots 51 in links 49 are wider at the bottom than at the top.

In operation, when the handle 46 is moved from up position (FIG. 3) to down position (FIG. 4), shaft 47 turns counterclockwise, as does control link 48. The turning of control link 48 causes the cutter link 49 to pull the blade 31 downward between the forward face of strip 9 and the rearwardmost sheet 6. The slanted bottom edge 32 cuts the studs 8 a few at a time as the blade 31 descends.

After the studs 8 are cut off, the strip 9 is released and forced rearward. A substantially vertical strip deflector 56 causes the strip to fall into the open top of scrap drawer 57, which extends longitudinally of the machine and is held in place by drawer guide 59. As shown in FIG. 1, the drawer 57 may be opened to discard the scrap which accumulates therein.

It will be understood that either the first strip 7, or the second strip 9, may be placed rearward, since it makes no difference whether the studs 8 are severed adjacent one strip or the other. Once one strip has been cut off from the book, the other strip may be pulled away from the sheets 6 so that the remaining lengths of the studs 8 are pulled out of the apertures in the sheets 6. This completes the debinding of the book and enables the sheets 6 to be removed or reorganized or permits other sheets to be added, so that the book can be rebound.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A debinder for cutting through studs passing through apertures in the sheets of a book and interconnecting first and second binding strips on the spine edge of first and second outer faces of a book comprising a platen to support the spine of the book, a front plate substantially perpendicular to said platen, a blade having a cutting edge, support means supporting said blade behind said front plate for movement parallel to said front plate from a first position remote from said platen to a second position, said front plate terminating in an edge spaced above said platen, whereby the first binding strip extends rearward behind said front plate, said support means guiding said blade between said first outer face and said first binding strip to cause said blade to sever the studs as it approaches second position and actuating means for reciproacating said blade between first and second positions.

2. A debinder according to claim 1 which further comprises a transverse pressure bar on said platen, means for advancing said pressure bar over the surface of said platen bar toward said front plate, and guide means maintaining said pressure bar in position against the upper surface of said platen, said pressure bar being shaped to engage the second outer face to advance the book over said platen toward said front plate.

3. A debinder according to claim 2 which further comprises an upstanding face on the edge of said pressure bar nearest said back plate, said face being formed with a notch shaped to receive the second binding strip.

4. A debinder according to claim 1 in which said support means comprises a blade backing plate below said edge and behind the plane of said back plate, said blade fitting flush against the forward face of said blade backing and reciprocating thereagainst.

5. A debinder according to claim 4 in which said blade is formed with a slot extending in the direction of its reciprocation and which further comprises a rivet through said slot and means securing said rivet to said blade backing plate.

6. A debinder according to claim 1 in which said blade backing plate terminates above the plane of said platen whereby the first strip may fit into the gap below said blade backing plate so that the first outer face may fit flush against said blade.

7. A debinder according to claim 6 in which there is an opening below said gap whereby, when the studs are cut off, the first strip may drop downward-rearward.

8. A debinder according to claim 7 which further comprises a strip drawer below said opening to catch the first strip.

9. A debinder according to claim 8 which further comprises a strip deflector behind said opening to direct the first strip into said scrap drawer.

10. A debinder according to claim 1 in which said platen terminates forward of the plane of said backing plate with a gap between said platen and said plane and which further comprises a blade guide filling said gap formed with a transverse slot to receive the lower edge of said blade.

11. A debinder according to claim 1 in which the lower edge of said blade is slanted, whereby said blade engages less than all of the studs at one time as it moves toward second position.

12. A debinder according to claim 11 in which said lower edge slants upward-outward from a lowermost point at the center of said lower edge.

13. A debinder according to claim 1 which further comprises sides attached to the lateral edges of said platen and said front plate, said sides being formed with slots, said blade having ears extending through said slots said actuating means comprising links operatively connected to said ears.

14. A debinder according to claim 13 in which said actuating means further comprises a transverse shaft, a handle oscillating about said shaft, and links connecting said handle and said ears.

15. A debinder according to claim 13 in which said sides extend forwardly of said back plate in extensions, said extensions limiting lateral movement of a book resting on said platen.

* * * * *